United States Patent [19]

Weber et al.

[11] 4,155,708

[45] May 22, 1979

[54] CONTINUOUS DYEING OR PRINTING PROCESS

[75] Inventors: Hans-Peter Weber, Basel; Alfred Litzler, Itingen; Hans W. Liechti, Oberwil; Branimir Milicevic, Riehen, all of Switzerland

[73] Assignee: Ciba-Geigy AG, Basel, Switzerland

[21] Appl. No.: 553,867

[22] Filed: Feb. 27, 1975

Related U.S. Application Data

[63] Continuation of Ser. No. 390,478, Aug. 22, 1973, abandoned, which is a continuation of Ser. No. 266,819, Jun. 27, 1972, abandoned, which is a continuation-in-part of Ser. No. 15,911, Mar. 2, 1970, abandoned.

[51] Int. Cl.[2] ..... D06P 1/50

[52] U.S. Cl. ..... 8/21 C; 8/1 A; 8/62; 8/94 R

[58] Field of Search ..... 8/21 C

[56] References Cited

U.S. PATENT DOCUMENTS

| | | | |
|---|---|---|---|
| 1,723,271 | 8/1929 | Ellis | 8/162 |
| 1,929,573 | 10/1933 | Whitehead | 8/175 |
| 2,323,871 | 6/1943 | Kienle | 8/62 |
| 3,046,076 | 7/1962 | Upsheer | 8/173 |
| 3,313,590 | 4/1967 | Delano | 8/173 |
| 3,468,694 | 9/1969 | Monty et al. | 427/37 |
| 3,510,243 | 5/1970 | Seuret | 8/39 |
| 3,523,749 | 8/1970 | MacLeod | 8/54.2 |

OTHER PUBLICATIONS

Schmidlen, The Preparation & Dyeing of Synthetic Fabrics, pp. 401–403, pub. 1963 by Chapman & Hall Ltd., London.

White, *Amer. Dyestuff* Rep. 7/67, 591–597.

Cheatham, Dyeing Fibre Blends, pub. 1966 pp. 259–261, pub. by D. Von Nostrand Co., Ltd., London.

*Primary Examiner*—Donald Levy

*Attorney, Agent, or Firm*—Edward McC. Roberts

[57] ABSTRACT

A process for continuous dyeing or printing, wherein a textile matrial is impregnated or printed with an emulsion of water and a halogenated aliphatic hydrocarbon containing at least one dyestuff, at least one of the phases of the emulsion containing a thickener of high molecular weight, and the dyestuff thus applied is fixed by steaming or heating.

6 Claims, No Drawings

CONTINUOUS DYEING OR PRINTING PROCESS

CROSS-REFERENCE TO RELATED APPLICATION

This application is a continuation of application Ser. No. 390,478, filed Aug. 22, 1973, which is a continuation of application Ser. No. 266,819, filed June 27, 1972, which is a continuation-in-part of application Ser. No. 15,911, filed Mar. 2, 1970, now all abandoned.

It is known that dyeing liquors and printing pastes can be thickened in two ways, namely, by dissolving therein substances of high molecular weight containing long-chain molecules or by the addition of an emulsion consisting of white spirit and an aqueous phase, the organic solvent not being recoverable on account of its flammability.

This invention provides a continuous dyeing or printing process, wherein a textile material, preferably consisting at least in part of synthetic fibres, is impregnated or printed with an emulsion of water and a halogenated aliphatic hydrocarbon preferably containing at least one water-insoluble dyestuff free from sulphonic acid groups, it being essential that at least one of the phases contains a thickener of high molecular weight, and the dyestuff thus applied is fixed by steaming or heating.

The emulsion-forming organic phase is a halogenated aliphatic hydrocarbon, for example, carbon tetrachloride, chloroform, methylene chloride, trichloroethylene, trichloroethane, tetrachloroethane, dibromoethylene and, in particular perchloroethylene.

The emulsion can be an oil-in-water emulsion or preferably a water-in-oil emulsion.

As a rule, the aqueous phase contains the high-molecular thickener, the latter being present in an amount less than 1% of the total weight of the emulsion, preferably less than 0.6%. In the process of the invention, there is no need for a washing operation after the fixation, because the amount of auxiliary left on the textile material is negligible and has no noticeable effect on the textile properties of the dyed or printed material, particularly when only disperse dyestuffs are used.

The following are examples of water-soluble viscous solids having a high intrinsic viscosity which, on dissolution, increase the viscosity of the aqueous phase; natural substances, for example, tragacanth, alginates, dextrans, dextrins, vegetable gums, for example, British gum, cellulose derivatives, for example, methyl cellulose, hydroxyethyl cellulose and carboxymethyl cellulose, starches and starch derivatives, for example, wheat starch or hydroxyethylated starch, and locust bean flour, and also synthetic polymers, for example, polyvinyl alcohol, and copolymers of free acrylic or methacrylic acid.

In order to render subsequent washing of the printed material unnecessary, the amount of high-molecular thickener used should not be more than 1% by weight per unit of weight, referred to the dry substance.

However, the additive used to increase viscosity can also be added to the organic phase, preferably in an amount of less than 1% of the total weight of the emulsion; in this case, resins soluble in organic solvents, selected cellulose esters and ethers, for example, ethyl cellulose or hydroxypropyl cellulose must be used.

The process can be used for textile materials consisting at least in part of synthetic fibres, for example, acrylic or acrylonitrile fibres, polyacrylonitrile fibres and fibres made from copolymers of acrylonitrile and other vinyl compounds, for example, acrylic esters, acrylic amides, vinylpyridine, vinyl chloride or vinylidene chloride, copolymers made from dicyanoethylene and vinyl acetate and also from acrylonitrile block copolymers, fibres made from polyurethanes, cellulose triacetate and secondary acetate, fibres made from polyamides, for example, nylon 6, nylon 6.6 or nylon 12, and especially fibres made from aromatic polyesters, for example, from terephthalic acid and ethylene glycol or 1,4-dimethylolcyclohexane, and copolymers of terephthalic and isophthalic acid and ethylene glycol, and also fibres made from unmodified polypropylene, basified polypropylene or polypropylene modified with nickel.

The material may be made entirely of synthetic fibres or it may consist of a mixture of natural and synthetic fibres, for example a mixture of synthetic fibre and wool, or a mixture of synthetic fibre and cellulosic fibre, for example, cotton or a regenerated cellulose fibre.

The textile material can be in the form of woven fabrics, knitted fabrics, non-woven fabrics, needle-tufted carpets, flock carpets and needle felt carpets.

The choice of dyestuff depends on the nature of the substratum to be coloured. For example, textile materials made from polyester fibres are dyed or printed with disperse dyestuffs, materials made from polypropylene with selected disperse dyestuffs, polyamide materials with acid, metal-complex, disperse or fibre-reactive disperse dyestuffs, acrylonitrile materials with basic or quaternated dyestuffs, wool materials with acid or metal-complex dyestuffs and cellulosic materials with substantive or fibre-reactive water-soluble dyestuffs. When the organic and/or aqueous phase contain dyestuffs having fibre-reactive groups, an agent capable of binding acid must be added to the dye liquor either at the commencement or during the dyeing process when cellulosic fibres are being dyed. The common agents are used, for example, sodium or potassium bicarbonate, ammonia, sodium carbonate, potassium carbonate, alkali metal hydroxide or alkaline earth metal hydroxides or sodium acetate, or, when dyeing union fabrics made from cellulosic fibres and linear polyesters, particularly sodium trichloroacetate and the like.

In some circumstances it can be advantageous to use compounds that increase the capacity of the dyestuffs to react with the cellulose ("catalysts"). Examples of such compounds are, in particular, tertiary amines or hydrazines. The adjuvants commonly used in dyeing, for example, urea, can also be present in the dye liquor.

In a preferred embodiment of the invention, the emulsion must contain at least one water-insoluble dyestuff, especially a disperse dyestuff, and the dyestuff must be at least partially dissolved in a halogenated hydrocarbon.

Of special interest are systems that additionally contain a water-soluble dyestuff which is dissolved in the aqueous phase, the said dyestuff preferably being an acid wool dyestuff or a substantive cotton dyestuff, or particularly a fibre-reactive dyestuff. Of special value are systems that contain a normal disperse dyestuff at least partially dissolved in the organic phase and a water-soluble fibre-reactive dyestuff dissolved in the aqueous phase. With these dyestuffs it is possible to dye union fabrics consisting of cellulosic fibres, especially cotton, and hydrophobic fibres, especially polyester fibres.

Suitable disperse dyestuffs are, for example, azo dyestuffs of the formula $$D{-}N{=}N{-}A{-}NR_1R_2,$$

in which D represents the residue of a diazo component, A represents a 1,4-phenylene residue and $R_1$ and $R_2$ each represents an alkyl group that may be substituted; styryl dyestuffs of the formula

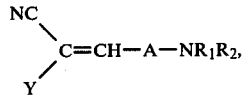

in which A, $R_1$ and $R_2$ have the meanings given above and Y represents a cyano, carbalkoxy or arylsulphonyl group, for example, a carbethoxy or phenylsulphonyl group; pyrazolone and aminopyrazole dyestuffs of the formula $$D{-}N{=}N{-}A',$$

in which D has the meaning given above and A' represents the residue of a pyrazolone or aminopyrazole, for example, the residue of a 1-phenyl-3-methyl-5-pyrazolone or a 5-aminopyrazole; azo dyestuffs of the formula D—N=N—B, in which D has the meaning given above and B represents the residue of an aliphatic, cycloaliphatic, aromatic or heterocyclic coupling component containing a hydroxyl group or an enolizable keto group in ortho-position to the azo group, especially an enolizable coupling component, for example, a phenol or naphthol that couples in ortho-position to the hydroxyl group, a pyrazolone, an aminopyrazole, a dihydroresorcinol or an acetoacetic acid acrylide. Disperse dyestuffs of the anthraquinone series may also be mentioned, for example, 1,4-diamino- or 1-hydroxy-4-amino-anthraquinones that may be substituted or 4,8-diaminoanthrarufins.

Further suitable water-soluble or disperse dyestuffs are disazo and polyazo dyestuffs, perinone, quinophthalone, oxazine, nitroso, nitro, stilbene and methine dyestuffs that are free from sulfonic acid groups, including the styryl, azamethine, polymethine and azostyryl dyestuffs. The dyestuffs may contain a fibre-reactive group, Also suitable are water-soluble and water-insoluble metal complex dyestuffs of the azo and formazan types.

Fibre-reactive dyestuffs that can be used in accordance with the invention may be water-soluble dyestuffs of the azo, anthraquinone or phthalocyanine series and also insoluble disperse dyestuffs, for example, monoazo, disazo and polyazo dyestuffs, anthraquinone, perinone, quinophthalone, oxazine, nitroso, nitro, phthalocyanine, stilbene and methine dyestuffs, including styryl, azamethine, polymethine and azostyryl dyestuffs that contain a fibre-reactive residue. Also suitable are water-soluble or water-insoluble metal-complex dyestuffs of the azo or formazan series.

The following residues and substituents are examples of fibre-reactive groupings that may be present in the dyestuffs: α,β-unsaturated acyl residues of aliphatic carboxylic acids, for example, the acyl residue, the α-bromo- or α-chloroacrylic residue and the residues of the formula

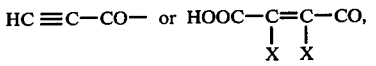

in which one of the symbols X represents a hydrogen atom and the other symbol X represents a chlorine or a bromine atom, and preferably residues containing exchangeable substituents. In such residues the exchangeable substituent, that is to say, the substituent capable of reaction with fibrous material in the presence of an alkali, can be combined in a heterocyclic residue containing two nitrogen atoms, for example, a pyrimidine residue, or bound to the acyl residue of an acid having at least one acid group of the formula

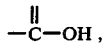

for example, an acyl residue derived from cyanuric acid or barbituric acid or an aliphatic or cycloaliphatic carboxylic acid. In the case of the acyl radical derived from cyanuric acid, the dyestuffs contain at least one halogen atom bound to a 1,3,5-triazine ring, for example, a dichlorotriazine residue or a monochlorotriazine residue, for example, those of the formula

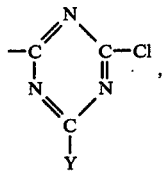

in which Y represents an amino group that may be further substituted or a substituted hydroxyl group or a thio group.

Residues that are derived from barbituric acid are, for example, dichloro-, trichloro- or bromo-pyrimidine residues as well as pyrimidine residues having eliminable sulphonyl groups. The acyl residues derived from aliphatic or cycloaliphatic carboxylic acids preferably contain halogen atoms and only a few, for example, 2 to 5, carbon atoms. Examples are the chloroacetyl residue, the α- or β-chloropropionyl residue and especially the α,β-dichloro- or α,β-dibromopropionyl residue, as well as the residues of the formulae

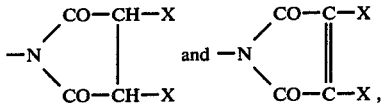

in which one of the symbols X represents a halogen atom (for example, a chlorine or a bromine atom) and the other symbol X represents a halogen or a hydrogen atom.

The water-soluble fibre-reactive dyestuffs that can be used in accordance with this invention may further contain the following fibre-reactive groups: 2-methylthio-4-fluoropyrimidine-5-carbonyl, 2,4-bis-(phenylsulphonyl)-triazinyl-6, 2-(3'-carboxyphenyl)-sulphonyl-4-chlorotriazinyl-6, 2-(3'-sulphophenyl)-sulphonyl-4-chlorotriazinyl-6, 2,4-bis-(3'-carboxyphenylsulphonyl-1')-triazinyl-6, 2-carboxymethylsulphonylpyrimidinyl-4, 2-methylsulphonyl-6-methylpyrimidinyl-4, 2-phenylsulphonyl-6-ethylpyrimidinyl-4, 2,6-bismethylsulphonylpyrimidinyl-6, 2,6-bismethylsulphonyl-5-chloropyrimidinyl-4, 2,4-bismethylsulphonylpyrimidinyl-5-sulphonyl, 2-methylsulphonylpyrimidinyl-4, 2-phenylsulphonylpyrimidinyl-4, 2-trichloromethylsulphonyl-6-methylpyrimidinyl-4, 2-methylsulphonyl-5-chloro-6-methylpyrimidinyl-4, 2-methylsulphonyl-5-bromo-6-methylpyrimidinyl-4, 2-methylsulphonyl-5-chloro-6-ethylpyrimidinyl-4, 2-methylsulphonyl-5-chloro-6-chloromethylpyrimidinyl-4, 2-methylsulphonyl-4-chloro-6-methylpyrimidine-5-sulphonyl, 2-methylsulphonyl-5-nitro-6-methylpyrimidinyl-4, 2,5,6-tris-methylsulphonylpyrimidinyl-4, 2-methylsulphonyl-5,6-dimethylpyrimidinyl-4, 2-ethylsulphonyl-5-chloro-6-methylpyrimidinyl-4, 2-methylsulphonyl-6-chloropyrimidinyl-4, 2,6-bismethylsulphonyl-5-chloropyrimidinyl-4, 2-methylsulphonyl-6-carboxypyrimidinyl-4, 2-methylsulphonyl-5-sulphopyrimidinyl-4, 2-methylsulphonyl-6-carbomethoxypyrimidinyl-4, 2-methylsulphonyl-5-carboxypyrimidinyl-4, 2-methylsulphonyl-5-cyano-6-methoxypyrimidinyl-4, 2-methylsulphonyl-5-chloropyrimidinyl-4, 2-sulphoethylsulphonyl-6-methylpyrimidinyl-4, 2-methylsulphonyl-5-bromopyrimidinyl-4, 2-phenylsulphonyl-5-chloropyrimidinyl-4, 2-carboxymethylsulphonyl-5-chloro-6-methylpyrimidinyl-4, 2-methylsulphonyl-6-chloropyrimidine-4- and -5-carbonyl, 2,6-bis-(methylsulphonyl)-pyrimidine-4- or -5-carbonyl, 2-ethylsulphonyl-6-chloropyrimidine-5-carbonyl, 2,4-bis-(methylsulphonyl)-pyrimidine-5-sulphonyl, 2-methylsulphonyl-4-chloro-6-methylpyrimidine-5-sulphonyl or -carbonyl groups; 2-chlorobenzthiazole-5- or -6-carbonyl- or -5- or -6-sulphonyl, 2-arylsulphonyl- or 2-alkylsulphonylbenzthiazole-5- or -6-carbonyl or -5- or -6-sulphonyl groups, for example, 2-methylsulphonyl or 2-ethylsulphonylbenzthiazole-5- or -6-sulphonyl or carbonyl, 2-phenylsulphonylbenzthiazole-5- or -6-sulphonyl- or carbonyl groups, and the corresponding derivatives of 2-sulphonylbenzthiazole-5- or -6-carbonyl or -sulphonyl groups containing sulpho groups bound to the fused benzene ring, for example, 2-chlorobenzthiazole-5- or -6-carbonyl or -sulphonyl, 2-chlorobenzimidazole-5- or -6-carbonyl or sulphonyl, 2-chloro-1-methylbenzimidazole-5- or -6-carbonyl or -sulphonyl, 2-chloro-4-methylthiazole-(1,3)-5-carbonyl or -4- or -5-sulphonyl residues and the N-oxide of the 4-chloro- or 4-nitroquinoline-5-carbonyl residue. Also to be mentioned are the 2,2,3,3-tetrafluorocyclobutanecarbonyl-1- or -sulphonyl-1, 2-fluoro-2-chloro-3,3-difluorocyclobutane-1-carbonyl and β-(2,2,3,3-tetrafluorocyclobutyl-1)-acryloyl, α- or β-bromoacryloyl and α- or β-alkyl or -arylsulphonylacryloyl residues.

The water-soluble fibre-reactive dyestuffs that can be used in accordance with this invention may also contain fibre-reactive groups bound by way of oxygen atoms, for example, glycidyl, 3-chloro-2-hydroxypropionyl, acrylic ester and chloroacetic acid ester groups.

Anionic or nonionic emulsifiers may be used to prepare the emulsions to be used in accordance with the invention. Cationic emulsifiers can also be used, particularly together with dyestuffs that are not soluble in water.

The following types of compound are important members of the group of nonionic tensides: (a) ethers of polyhydroxy compounds, for example, polyoxalkylated fatty alcohols, polyoxalkylated polyols, polyoxalkylated mercaptans and aliphatic amines, polyoxalkylated alkylphenols and naphthols, polyoxyalkylated alkylarylmercaptans and alkylarylamines. (b) Fatty acid esters of ethylene glycols and polyethylene glycols and of propylene glycol and butylene glycol, glycerol, polyglycerols and pentaerythritol, and also sugar alcohols, for example, sorbitol, sorbitans and saccharose. (c) N-hydroxyalkyl carboxylic acid amides, polyoxalkylated carboxylic acid amides and sulphonamides.

Examples of suitable tensides belonging to these groups are: the addition products of 8 mols of ethylene oxide and 1 mol of para-tertiary-octylphenol, 15 or 6 mols of ethylene oxide and castor oil, 20 mols of ethylene oxide and the alcohol $C_{16}H_{33}OH$; addition products of ethylene oxide and di-[α-phenylethyl]-phenols, polyethylene oxide tertiary-dodecylthioethers, polyamine-polyglycolethers; addition products of 15 or 30 mols of ethylene oxide and 1 mol of the amine $C_{12}H_{25}NH_2$ or $C_{18}H_{37}NH_2$, oleic acid-triethyleneglycol ester, oleic acid-polyethyleneglycol 200-ester, oleic acid-polyethyleneglycol 400-ester; the adducts of 1 mol of oleic acid and 4 or 5 mols of ethylene oxide and the adduct of 4 mols of ethylene oxide and 1 mol of oleic acid-sorbitan ester and sorbitan-monolaurate, -monopalmitate and -monostearate.

Specially preferred are W/O (water-in-oil) emulsifiers having an H.L.B range of 3.5 to 6 (cf. Davis & Rideal, Interfacial phenomena, New York 1963, page 373).

After the desired depth of shade has been obtained, the dyed material is freed from dye liquor and then treated with steam or a current of hot air to remove any residual solvent.

The continuous dyeing process is carried out in the usual manner by padding followed by thermofixation or steaming.

After dyeing, it is advantageous to remove as completely as possible any unfixed dyestuff. To this end, the dyed material is subjected to a thorough rinse in warm and cold water and a soaping process in the presence of a non-ionic or anionic dispersing and/or wetting agent; however, it is generally sufficient to subject the goods to a treatment with the water and solvent mixture on which the dyebath is based.

The process of the invention yields dyeings that generally display good fastness to light and that are distinguished by excellent properties of wet fastness.

The following Examples illustrate the invention, the parts and percentages being by weight, unless otherwise stated.

EXAMPLE 1

A needle-felt carpet made from unmodified polypropylene fibre is padded with an emulsion comprising 0.5 part of the dyestuff of the formula

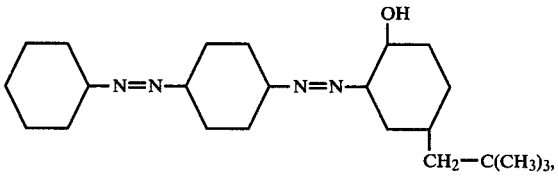

21 parts of water, 0.5 part of the reaction product obtained from 1% of hexamethylene diisocyanate and 99% of the adduct of 70 mols of ethylene oxide and 1 mol of oleic acid, 78 parts of tetrachloroethylene and 0.35 part of sodium alginate. The liquor uptake amounts to 100%. The padded needle-felt carpet is dried in a current of warm arm and then subjected to thermofixation for 2 minutes at 140° C. A very level yellow dyeing is obtained. Although the floor covering is not washed out, it possesses a good handle.

EXAMPLE 2

A printing paste comprising 0.5 part of the dyestuff of the formula

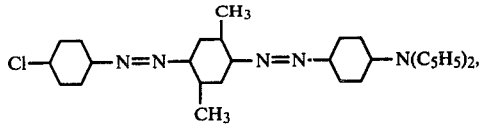

0.5 part of the reaction product obtained from 1% of hexamethylene diisocyanate and 99% of the adduct of 70 mols of ethylene oxide and 1 mol of oleic acid, 20 parts of water, 78 parts of tetrachloroethylene and 0.7 part of carboxymethyl starch (Solvitose C-5) is printed on to a needle-felt carpet made from an unmodified polypropylene fibre. The print is dried and then subjected to thermofixation for 2 minutes at 140° C. The fixed red print is first rinsed in cold water. A subsequent wash with 2 g/l of an adduct of 1 mol of nonylphenol and 9 mols of ethylene oxide together with 1 g/l trisodium phosphate at 60° C. for 30 minutes shows that very little dyestuff is removed.

EXAMPLE 3

A printing paste comprising 6 parts of the blue dyestuff of the formula

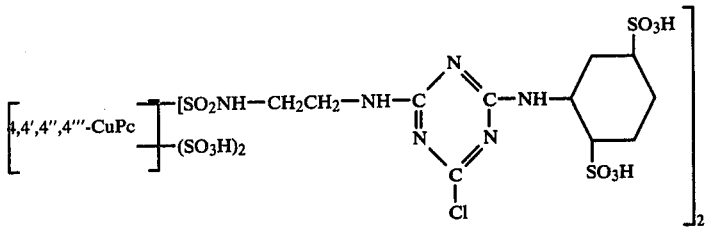

5 parts of urea, 1.5 parts of sodium carbonate, 30 parts of water, 5 parts of the reaction product obtained from 1% of hexamethylene diisocyanate and 99% of the adduct of 70 mols of ethylene oxide and 1 mol of oleic acid, 100 parts of tetrachloroethylene and 1 part of the dyestuff (partially dissolved in the organic phase) of the formula

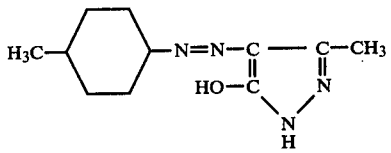

is padded on to a union fabric consisting of 67% of polyester fibre and 33% of cotton fibre, the fabric is squeezed to a liquor uptake of 100%, dried for one minute at 50° C. in a hot-air chamber and then subjected to thermofixation for one minute at 200° C. The fabric is then rinsed with cold water and soaped in warm water containing 2 g/l of the addition product of 9 mols of ethylene oxide and 1 mol of nonylphenol. A two-tone dyeing having excellent shade differentiation on the fibre is obtained. The reactive dyestuff is fixed on the cellulosic fibre by a covalent chemical bond and cannot be extracted.

EXAMPLE 4

25 Parts of the oleic acid ester of polyethylene glycol 300 are mixed with 485 parts of perchloroethylene; 5 parts of the dyestuff of the formula

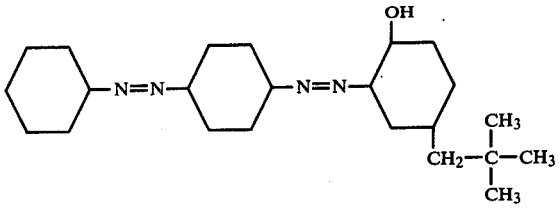

are then added. 200 Parts of a solution comprising 197 parts of water and 3 parts of carboxymethyl starch (Solvitose C-5) are then added while stirring to form an emulsion. A needle-felt carpet made from unmodified polypropylene fibre is padded with this emulsion at room temperature and squeezed to a liquor uptake of 80%. The padded carpet is dried in a current of warm air, thermosoled for 2 minutes at 140° C. and then washed off in the usual manner. A level yellow dyeing possessing excellent fastness properties is obtained.

EXAMPLE 5

30 Parts of dimethylacetamide are mixed with 25 parts of the oleic acid ester of polyethylene glycol 300. 5 Parts of the dyestuff of the formula

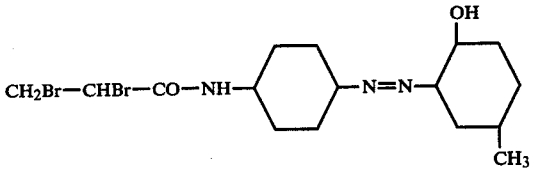

are added and the batch is diluted with 485 parts of perchloroethylene. A solution comprising 215 parts of water and 5 parts of carboxymethyl cellulose is then added while stirring to form an emulsion. A tufted carpet having a pile made of polycaprolactam is padded with this emulsion at room temperature and squeezed to a liquor uptake of 125%. The carpet is dried in a current of hot air, thermosoled for 3 minutes at 200° C. and then washed off in the usual manner. A level yellow dyeing possessing excellent properties of fastness and good reservation on jute is obtained.

EXAMPLE 6

Dyeing is carried out in the manner described in the preceding Example, but using the dyestuff of the formula

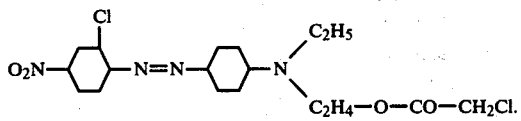

A level claret dyeing possessing excellent properties of fastness is obtained.

EXAMPLE 7

6 Parts of a paste containing 2 parts of the dyestuff of the formula

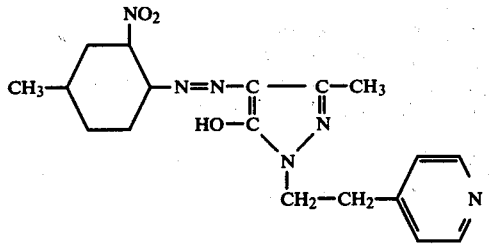

in a finely divided form in oleic acid is added while stirring to an emulsion consisting of 2.5 parts of the reaction product obtained from 98.75% of a condensation product derived from 1 mol of oleylalcohol and 80 mols of ethylene oxide and 1.25% of hexamethylene-1,6-diisocyanate, 220 parts of water, 320 parts of perchloroethylene and 8 parts of sodium alginate. A tufted carpet having a polyester pile is padded with this emulsion at room temperature and squeezed to a liquor uptake of 130%. The carpet is dried in a current of warm air, thermosoled for 5 minutes at 220° C. and then washed off in the usual manner. A yellow dyeing possessing excellent properties of fastness and displaying good reservation on jute is obtained.

EXAMPLE 8

A water-in-oil emulsion consisting of 6 parts of the blue dyestuff of the formula

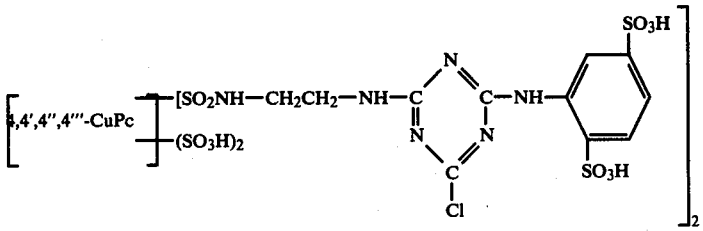

5 parts of urea, 1.5 parts of sodium carbonate, 30 parts of water, 5 parts of a 12.5% aqueous solution of the reaction product obtained from 1% of hexamethylene diisocyanate and 99% of the adduct of 80 mols of ethylene oxide and 1 mol of oleic acid, 0.2 parts of sodium alginate dissolved in 20 parts of water, 100 parts of tetrachloroethylene and 10 parts of the yellow dyestuff of the formula

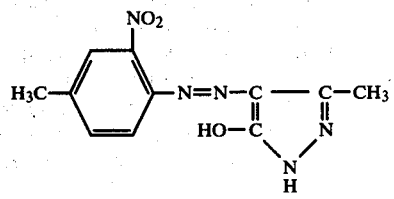

is padded on to a union fabric consisting of 67% of polyester fibre and 33% of cotton fibre, the fabric is squeezed to a liquor uptake of 100%, dried for one minute at 100° C. in a hot-air chamber and then subjected to thermofixation for one minute at 200° C. The fabric is then rinsed with cold water and soaped in warm water containing 2 g/l of the addition product of 9 mols of ethylene oxide and 1 mol of nonylphenol. A two-tone dyeing having excellent shade differentiation on the fibre is obtained. The reactive dyestuff is fixed on the cellulosic fibre by a covalent chemical bond and cannot be extracted.

EXAMPLE 9

A water-in-oil emulsion consisting of 6 parts of the red dyestuff of the formula

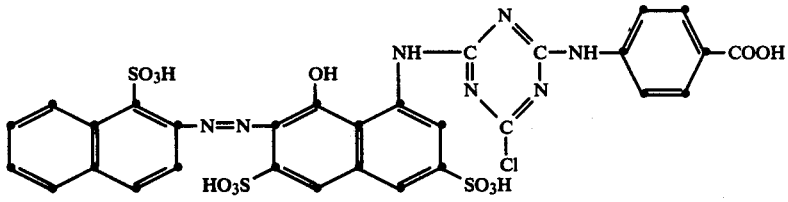

5 parts of urea, 1.5 parts of sodium carbonate, 30 parts of water, 5 parts of a 12.5% aqueous solution of the reaction product obtained from 1% of hexamethylene diisocyanate and 99% of the adduct of 80 mols of ethylene oxide and 1 mol of oleic acid, 0.3 parts of carboxymethyl starch dissolved in 20 parts of water, 100 parts of tetrachloroethylene and 10 parts of the yellow dyestuff of the formula

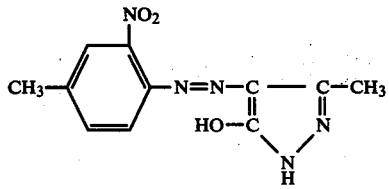

is padded on to a fabric consisting of 67% of polyester fibre and 33% of cotton fibre, the fabric is squeezed to a liquor uptake of 100%, dried for one minute at 100° C. in a hot-air chamber and then subjected to thermofixation for one minute at 200° C. The fabric is then rinsed with cold water and soaped in warm water containing 2 g/l of the addition product of 9 mols of ethylene oxide and 1 mol of nonylphenol. A two-tone dyeing having excellent shade differentiation on the fibre is obtained. The reactive dyestuff is fixed on the cellulosic fibre by a covalent chemical bond and cannot be extracted.

We claim:

1. A process for continuous dyeing or printing to obtain a two-color effect on mixed textile material, comprising a mixture of cellulose fibers and hydrophobic, synthetic polyester fibers, which comprises the steps of (a) applying a water and oil emulsion to the textile material, wherein the water contains, dissolved therein, a water-soluble dyestuff having affinity for the cellulosic fibers, wherein the oil is a halogenated aliphatic hydrocarbon containing at least partially dissolved therein, a disperse dyestuff having affinity for the polyester fibers, and wherein the emulsion contains a nonionic emulsifying agent and less than 0.6% of a water-soluble viscous solid having a high intrinsic viscosity selected from the group consisting of an alginate, methyl cellulose, hydroxyethylcellulose, carboxymethylcellulose, starch, hydroxyethylated starch, carboxymethylated starch, and (b) thereafter heating the dyed fibers to fix the dyestuffs thereto.

2. The process of claim 1, wherein the oil is more than 80% by volume of the emulsion.

3. The process of claim 2, wherein the oil is tetrachloroethylene.

4. The process of claim 1, wherein the water-soluble dyestuff is a fiber-reactive dyestuff.

5. The process of claim 1, wherein the water-soluble viscous solid is sodium alginate or carboxymethyl starch.

6. The process of claim 1, wherein the cellulosic fibers are cotton fibers.

* * * * *

UNITED STATES PATENT AND TRADEMARK OFFICE

CERTIFICATE OF CORRECTION

PATENT NO. : 4,155,708
DATED : May 22, 1979
INVENTOR(S) : Hans-Peter Weber et al.

It is certified that error appears in the above-identified patent and that said Letters Patent are hereby corrected as shown below:

Title page, [30] Foreign Application Priority Data should be

--Mar. 5, 1969 [CH] Switzerland .....3338/69--.

Signed and Sealed this

First Day of July 1980

[SEAL]

Attest:

SIDNEY A. DIAMOND

Attesting Officer

Commissioner of Patents and Trademarks